United States Patent [19]

Backstein et al.

[11] 4,223,608

[45] Sep. 23, 1980

[54] SAFETY DEVICE FOR PERCUSSION-FUSE OF RIFLED MISSILES

[75] Inventors: Guenter Backstein, Meerbusch; Walter Unger, Krefeld, both of Fed. Rep. of Germany

[73] Assignee: Rheinmetall GmbH, Duesseldorf, Fed. Rep. of Germany

[21] Appl. No.: 931,272

[22] Filed: Aug. 4, 1978

[30] Foreign Application Priority Data

Aug. 6, 1977 [DE] Fed. Rep. of Germany ..... 2735575

[51] Int. Cl.[3] ..... F42C 15/34

[52] U.S. Cl. ..... 102/244; 102/237

[58] Field of Search ..... 102/240, 244, 237

[56] References Cited

U.S. PATENT DOCUMENTS

| | | | |
|---|---|---|---|
| 2,362,987 | 11/1944 | Church et al. | 102/240 |
| 3,076,410 | 2/1963 | Guerne | 102/240 |
| 3,580,177 | 5/1971 | Krahulec | 102/244 |
| 4,026,216 | 5/1977 | Backstein | 102/244 |

FOREIGN PATENT DOCUMENTS

| | | | |
|---|---|---|---|
| 176403 | 8/1961 | Sweden | 102/244 |

*Primary Examiner*—Charles T. Jordan

[57] ABSTRACT

In a rifled missile having a primer tube or firing channel, a safety device adapted to coact with a percussion fuse. The safety device is disposed in the missle transversely across the primer tube between the impact-sensitive primer and a booster charge. The primer tube axially extends from the impact-sensitive primer to the booster charge. The safety device includes a blocking disc and a biased tape-reel surrounding the blocking disc and bearing against it. The tape-reel is adapted to unwind when under the influence of a predetermined centrifugal force to thereby release the blocking disc which is then freed to turn oppositely relative to the rotary direction of the missile due to the influence of a predetermined inertial force to thereby unblock the primer tube.

3 Claims, 2 Drawing Figures

SAFETY DEVICE FOR PERCUSSION-FUSE OF RIFLED MISSILES

BACKGROUND OF THE INVENTION

The invention relates to a safety device for a percussion fuse in a rifled missile. The firing channel or primer tube which leads from the percussion fuse to a booster charge is blocked by such a safety device and is only unblocked by virtue of inertial forces when certain ballistic flight conditions of the rifled missile have been attained.

Such types of safety devices form part of the state of the art. For example, such a safety device is disclosed in German Pat. No. 844,564. In this patent there is disclosed a percussion fuse for rifled missiles which has a blocking element transversely movably mounted with respect to the ignition channel. Thus the blocking element of this device of the state of the art is movable at right angles with respect to the axis of the fuse and is held in position by means of the supporting spring. Thus the blocking element is held in position by the spring after launching of the missile, as well as during the transport and loading positions of the missile. The blocking element is adapted to assume a blocking position in front of the central bore in which the firing pin is mounted.

This blocking position of the blocking element is also maintained during the acceleration of the missile in the firing tube which occurs after launching. The centrifugal forces imparted to the missile only become fully effective after the missile has left the mouth of the launching tube. Due to the location of the center of gravity of the blocking element, the latter is laterally slidably displaced against the action of the spring. This shift of the center of gravity, which is required for the slidable lateral displacement of the blocking element, is effected by means of providing the blocking element with pockets filled with liquid mercury at each side thereof, by means of which an equilibrium is established. The membrane-cover which seals the pocket is only pierced under the influence of the centrifugal force so that the liquid mercury pours out of the pocket to a hollow space. Since the other pocket remains filled with liquid mercury, there occurs a shift of the center of gravity of the blocking element which in turn produces a shift of the blocking element against the force of the spring, whereby the central bore in which the firing pin is disposed is unblocked so that the firing pin can now hit the pellet-primer upon impact of the missile.

This known blocking element is formed by a slidable element of oval shape. The complementary portion which, jointly with the oval-shaped blocking element, would jointly make for a full circle, is occupied by the supporting spring of the device. In addition thereto, the blocking element is provided with kidney-shaped pockets filled with liquid mercury. The entire construction of the blocking element is therefore quite complicated and expensive. A significant improvement of the safety of the primer tube is not possible with this known fuse because the pouring out of the liquid mercury from one of the pockets occurs without appreciable delay and the surmounting of the spring force during the slidable lateral movement of the blocking element can even take place spontaneously.

SUMMARY OF THE INVENTION

It is the general object of this invention to provide a blocking disc for a percussion fuse in a rifled missile in which the afore-described drawbacks of the devices of the state of the art are eliminated or at least mitigated.

It is another object of this invention to provide a safety-device for the primer tube in a percussion fuse for rifled missiles which includes only a few parts of a rocker construction and therefore is inexpensive to produce and, because of the simplicity of the construction, achieves a high degree of operating safety.

The objects of the invention are obtained by providing a blocking disc which is slidably movably arranged in a direction normal to the central bore of the missile so that this sliding disc is adapted to block the central bore. The sliding disc is surrounded by a coiled band or tape-reel which is adapted to unwind under the influence of a centrifugal force. The winding direction of the tape-reel effects a rotation of the blocking disc in a direction opposite to the spinning direction of the missile which causes frictional contact between the blocking disc and the cage in which it is mounted so that a deflection of the blocking disc from the region of the central bore occurs.

According to a further feature of the invention the blocking disc and tape reel are coaxially mounted in an annular chamber or cage, the inner bore of which forms the central bore of the missile. The annular space of the annular cage is dimensioned so that it can receive completely or at least partially the blocking disc when the tape reel is opened and the central bore is exposed.

Finally, the blocking disc is guided in a slit of the central bore, in accordance with the invention, which is enclosed by the annular cage, whereby the blocking disc is constructed and has a diameter of such a dimension that it slightly projects into the annular space of the annular cage.

This novel type of safety device for the primer tube includes only, in addition to the massive blocking disc and the tape reel, two very simple parts which interact, with the aid of the centrifugal forces produced by the missile spin, to produce a delayed but nevertheless secure exposure of the central bore.

In this connection it should be noted that it is irrelevant whether the blocking disc which closes the central bore serves to interrupt a mechanical motion, as for example to prevent the piercing by a firing pin or firing bolt of an ignition pellet, or serves to interrupt a pyrotechnic combustion path in the fuse, for purposes of further improving the safety of the primer tube ignition process in the missile.

BRIEF DESCRIPTION OF THE DRAWING

The invention is further set forth in the following detailed description taken in conjunction with the appended drawing, in which.

DETAILED DESCRIPTION

Figure 1:
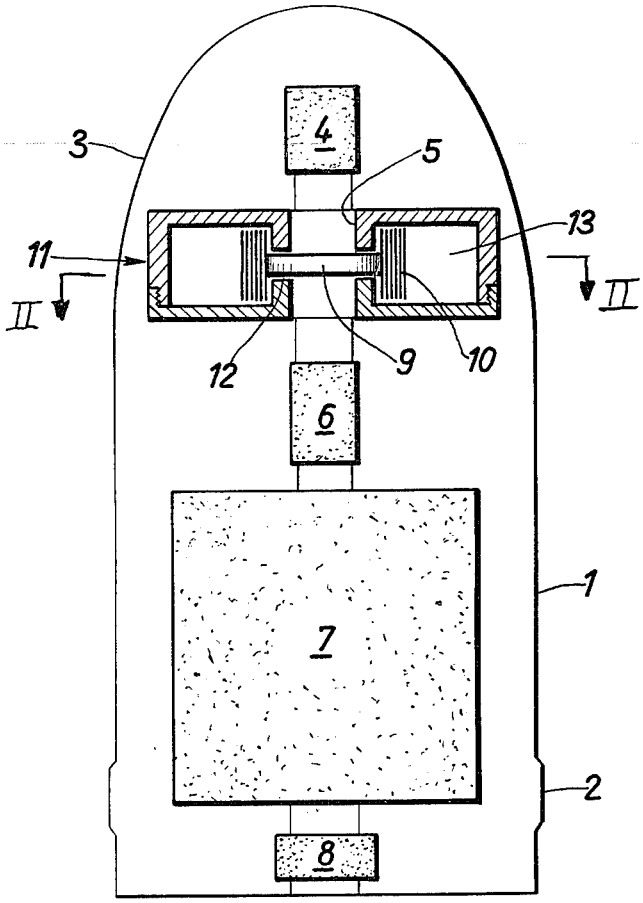
FIG. 1 is a schematic view, partially in cross section of an explosive missile having a fuse and safety device for the primer tube.
Figure 2:
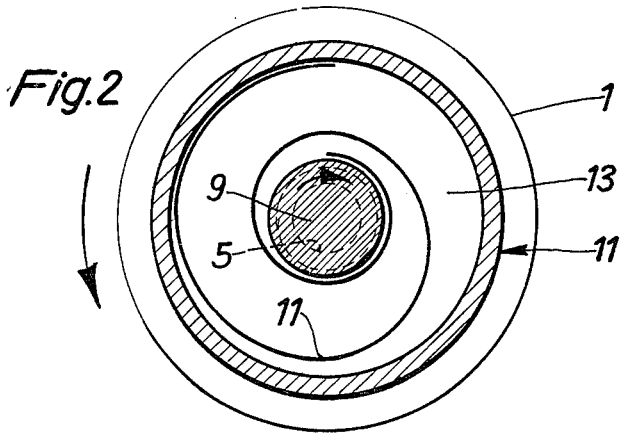
FIG. 2 is a cross sectional view along line II—II of FIG. 1.

Referring now to the drawing there is illustrated an explosive missile 1 having a radially projecting guide band 2. A impact fuse is mounted in the nose 3 of the missile. The impact fuse includes an impact-sensitive primer 4 in lieu of the conventional firing pin or firing bolt. Such impact-sensitive primer 4 forms part of the state of the art. When the explosive missile 1 impacts on the target, the primer 4 is ignited whereby a firing jet rapidly traverses a combustion path defined by the axial bore 5, at the end of which there is disposed a booster charge 6. In lieu of a conventional booster charge, the charge 6 may also be a delayed action charge. The firing jet of the primer 4 ignites this booster charge 6. After ignition of the booster charge 6, the explosive charge 7, which occupies most of the internal hollow space of the missile, is detonated. A tracer composition 8 may optionally be mounted in the tail section of the missile. This tracer composition 8 is ignited by the propellant charge gases. The missile can therefore be observed during its trajectory.

The ignition material of the primer 4 is so sensitive that even contact with tree branches and the like positioned in the trajectory path of the missile can cause it to ignite. In order to prevent that the explosive missile 1 is exploded in the vicinity of the outlet mouth of the firing tube, there is mounted a safety arrangement between the primer 4 and the booster charge 6. This arrangement consists of a massive round blocking disc 9 which is enclosed by a tape-reel 10. Both parts are mounted inside of an annular cage 11. The blocking disc 9 is slidably movably disposed in a slot 12 located about midway along the axial extent of the internal radial wall of the annular cage 11. This slot 12 extends radially normal relative to the central bore 5. The radially outer extent of the blocking disc 9 slightly projects into the annular space 13 of the annular cage 11. As a result, the innermost winding of the tape-reel 10 abuts against the circumferential periphery of the blocking disc 9 but not against the inner wall surface of the annular cage 11. The tape-reel 10 is prestressed so that when the missle is in the transport and loading position it envelopes the blocking disc 9 in the manner of a closed bundle of springs. Inertial forces predominate during the launching and acceleration phase of the missile 1. The blocking disc 9 is strongly biased against the rear bearing surface of the slot 12, viewed in the flight direction. The tape-reel 10 also firmly is pressed with its winding layers against the rear surface of the annular cage 11. The acceleration of the missile ceases as it leaves the outlet mouth of the firing tube, so that from that point onwards the effect of the centrifugal forces fully come into play, which effects a lifting and slidable movement of the blocking disc 9 thereby at least partially unblocking the central bore 5 and neutralizing the safety for the primer tube coacting with the primer 4. At this stage the tape-reel 10 opens. For this purpose, the tape-reel 10 requires, according to the material selected and the length thereof, about 5–20 ms, on the assumption that the rotational velocity of the missile is about 50,000 rpm. In accordance with the direction of winding of the tape-reel 10, a twist is imparted on the blocking disc 9, which is in a direction opposite to that of the direction of rotation of the missle 1.

Due to the rotation in mutually opposite directions of the blocking disc 9 and the missile 1, there is caused a frictional contact between the two bodies, which, in turn, causes a deflection of the blocking disc 9 from the axis of the missile 1. As a result, the central bore 5 is unblocked, so that ignition transfer from the primer 4, by way of the booster charge 6 to the explosive charge 7 can now take place upon impacting at the target or at least at a predetermined minimum distance from the outlet mouth of the firing tube.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A safety device for a primer tube of rifled missiles having a percussion fuse and an axially extending bore forming the primer tube, comprising in combination, a blocking disc transversely slidably movably mounted in said missile relative to said primer tube in slotted wall means of said primer tube between a blocking position in which said primer tube is blocked by said blocking disc and an unblocked position in which said primer tube is at least partially unblocked by said blocking disc;

a pre-stressed tape-reel enveloping said blocking disc and being adapted to be at least partially unwound in an unwinding direction under the influence of a predetermined centrifugal force, said missile having imparted to it a spin during its trajectory which is in a direction opposite to the unwinding direction of said tape-reel, said predetermined centrifugal force causing a slidable movement of said blocking disc determined by the unwinding direction of said tape-reel which is in a direction substantially opposite to the direction of twist of said missile, and which is at least vertically caused by the frictional contact between the blocking disc and said slotted wall means of said primer tube, to thereby effect a movement of said blocking disc from said blocking position to said unblocked position.

2. The safety device for the primer tube of rifled missiles having a percussion fuse and an axially extending bore forming the primer tube as set forth in claim 1, including an annular cage coaxially mounted in said missile and having an internal bore which coincides with said primer tube, said slotted wall means and said tape-reel being disposed in said annular cage, said annular cage being sufficiently dimensioned to accommodate said blocking disc when moved from said blocking position through said slotted wall means to said unblocking position after said tape-reel has been at least partially unwound by said predetermined centrifugal force in said annular cage.

3. The safety device for the primer tube of rifled missiles having a percussion fuse and an axially extending bore forming the primer tube as set forth in claim 2, wherein said blocking disc when in said blocking position slightly projects through said slotted wall means into said annular cage.

* * * * *